US006879298B1

(12) United States Patent
Zarro et al.

(10) Patent No.: US 6,879,298 B1
(45) Date of Patent: Apr. 12, 2005

(54) MULTI-BAND HORN ANTENNA USING CORRUGATIONS HAVING FREQUENCY SELECTIVE SURFACES

(75) Inventors: Michael S. Zarro, Melbourne Beach, FL (US); Heriberto J. Delgado, Melbourne, FL (US); William D. Killen, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/685,985

(22) Filed: Oct. 15, 2003

(51) Int. Cl.[7] ..... H01Q 13/00
(52) U.S. Cl. ..... 343/786; 343/756
(58) Field of Search ..... 343/756, 786, 343/772, 909; 333/21 A, 126

(56) References Cited

U.S. PATENT DOCUMENTS

| | | | | | |
|---|---|---|---|---|---|
| 3,754,271 | A | * | 8/1973 | Epis | 343/756 |
| 4,266,203 | A | * | 5/1981 | Saudreau et al. | 333/21 A |
| 4,387,377 | A | * | 6/1983 | Kandler | 343/756 |
| 4,998,113 | A | * | 3/1991 | Raghavan et al. | 343/776 |
| 5,258,768 | A | * | 11/1993 | Smith | 343/786 |
| 5,461,394 | A | * | 10/1995 | Weber | 343/786 |
| 5,552,797 | A | * | 9/1996 | Cook | 343/786 |
| 5,959,594 | A | * | 9/1999 | Wu et al. | 343/909 |
| 6,218,978 | B1 | * | 4/2001 | Simpkin et al. | 342/5 |
| 6,522,306 | B1 | * | 2/2003 | Parrikar et al. | 343/786 |
| 6,677,911 | B2 | * | 1/2004 | Moheb | 343/786 |

OTHER PUBLICATIONS

U.S. Appl. No. 10/448,973, filed May 30, 2003, Delgado et al.
U.S. Appl. No. 10/184,277, filed Jun. 27, 2002, Killen et al.
U.S. Appl. No. 10/185,443, filed Jun. 27, 2002, Killen et al.
U.S. Appl. No. 10/184,332, filed Jun. 27, 2002, Killen et al.
U.S. Appl. No. 10/185,251, filed Jun. 27, 2002, Parsche et al.
U.S. Appl. No. 10/185,847, filed Jun. 27, 2002, Killen et al.
U.S. Appl. No. 10/185,275, filed Jun. 27, 2002, Killen et al.
U.S. Appl. No. 10/185,273, filed Jun. 27, 2002, Killen et al.
U.S. Appl. No. 10/308,500, filed Dec. 3, 2002, Killen et al.
U.S. Appl. No. 10/373,935, filed Feb. 25, 2002, Killen et al.
U.S. Appl. No. 10/404,285, filed Mar. 31, 2003, Killen et al.
U.S. Appl. No. 10/404,981, filed Mar. 31, 2003, Killen et al.
U.S. Appl. No. 10/404,960, filed Mar. 31, 2003, Killen et al.
U.S. Appl. No. 10/185,144, filed Jun. 27, 2002, Killen et al.
U.S. Appl. No. 10/185,266, filed Jun. 27, 2002, Killen et al.
U.S. Appl. No. 10/185,162, filed Jun. 27, 2002, Rumpf, Jr. et al.
U.S. Appl. No. 10/185,824, filed Jun. 27, 2002, Killen et al.
U.S. Appl. No. 10/185,187, filed Jun. 27, 2002, Killen et al.
U.S. Appl. No. 10/185,855, filed Jun. 27, 2002, Killen et al.
U.S. Appl. No. 10/185,459, filed Jun. 27, 2002, Killen et al.
U.S. Appl. No. 10/185,480, filed Jun. 27, 2002, Killen et al.
U.S. Appl. No. 10/439,094, filed May 15, 2003, Delgado et al.

(Continued)

*Primary Examiner*—Tan Ho
(74) *Attorney, Agent, or Firm*—Sacco & Associates, PA

(57) ABSTRACT

An antenna (100) for microwave radiation including a first horn (135) which includes a plurality of corrugations (150). At least one of the corrugations (150) is formed of a frequency selective surface (FSS) (138). The FSS has a plurality of FSS elements (305) coupled to at least one substrate (310). The substrate (310) can define a first propagation medium such that an RF signal having a first wavelength in the first propagation medium can pass through the FSS (300). The FSS (300) is coupled to a second propagation medium such that in the second propagation medium the RF signal has a second wavelength which is at least twice as long as a physical distance between centers of adjacent FSS elements (305).

21 Claims, 7 Drawing Sheets

OTHER PUBLICATIONS

U.S. Appl. No. 10/185,570, filed Jun. 27, 2002, Killen et al.
U.S. Appl. No. 10/184,854, filed Jun. 27, 2002, Killen et al.
U.S. Appl. No. 10/185,215, filed Jun. 27, 2002, Killen et al.
U.S. Appl. No. 10/185,480, filed Jun. 27, 2002, Killen et al.
U.S. Appl. No. 10/614,626, filed Jul. 7, 2003, Zarro et al.
Thomas, Design of Wide–Band Corrugated Conical Horns for Cassegrain Antennas, IEEE Transactions on Antennas and Propagation, vol. AP–34, No. 6, Jun. 1986.
Takeda, Broadbanding of Corrugated Conical Horns by Means of the Ring–Loaded Currugated Waveguid Structure, IEEE Transactions on Antennas and Propagation, vol. AP–24, No. 6, Nov. 1976.
Clarricoats, Broadband low–crosspolarisation horn, Electronics Letters, vol. 30, No. 25, Dec. 8, 1984.
Worm, Electromagnetic fields of corrugated conicalhorns with elliptical cross section described by Lame functions, Radio Science, vol. 19, No. 5, pp. 1219–1224, Sep.–Oct., 1984.
Zhang, Design of Conical Corrugated Feed Horns for Wide–Band High–Frequency Applications, IEEE Transactions on Microwave Theory and Techniquest, vol. 41, No. 8, Aug. 1993.

* cited by examiner

MULTI-BAND HORN ANTENNA USING CORRUGATIONS HAVING FREQUENCY SELECTIVE SURFACES

BACKGROUND OF THE INVENTION

Statement of the Technical Field

The inventive arrangements relate generally to methods and apparatus for horn antennas, and more particularly to horn antennas which can operate in multiple frequency bands.

Description of the Related Art

Conventional electromagnetic waveguides and horn antennas are well known in the art. A waveguide is a transmission line structure that is commonly used for microwave signals. A waveguide typically includes a material medium that confines and guides a propagating electromagnetic wave. In the microwave regime, a waveguide normally consists of a hollow metallic conductor, usually rectangular, elliptical, or circular in cross section. This type of waveguide may, under certain conditions, contain a solid, liquid, liquid crystal or gaseous dielectric material.

In a waveguide, a "mode" is one of the various possible patterns of propagating or standing electromagnetic fields. Each mode is characterized by frequency, polarization, electric field strength, and magnetic field strength. The electromagnetic field pattern of a mode depends on the frequency, refractive indices or dielectric constants and relative permeabilities, and waveguide or cavity geometry. With low enough frequencies for a given structure, no transverse electric (TE) or transverse magnetic (TM) modes will be supported. At higher frequencies, higher modes are supported and will tend to limit the operational bandwidth of a waveguide. Each waveguide configuration can form different transverse electric or transverse magnetic modes of operation. The most useful mode of propagation is called the Dominant Mode. Other modes with different field configurations can occur unintentionally or can be caused deliberately.

In operation, a waveguide will have field components in the x, y, and z directions. A rectangular waveguide will typically have waveguide dimensions of width, height and length represented by a, b, and l respectively. The cutoff frequency or cutoff wavelength (for transverse electric (TE) modes) for a rectangular waveguide can be represented as:

$$(f_c)_{mn} = \frac{1}{2\pi\sqrt{\mu\varepsilon}}\sqrt{\left(\frac{m\pi}{a}\right)^2 + \left(\frac{n\pi}{b}\right)^2} \quad \text{and}$$

$$(\lambda_c)_{mn} = \frac{2}{\sqrt{\left(\frac{m}{a}\right)^2 + \left(\frac{n}{b}\right)^2}}$$

where a is the width of the wider side of the waveguide, and b is a width of the waveguide measured along the narrow side, $\epsilon$ and $\mu$ are the permittivity and permeability of the dielectric inside the waveguide, and m, n are mode numbers. The lowest frequency mode in a rectangular waveguide is the $TE_{10}$ mode. In this mode, the equation for the signal wavelength at the cutoff frequency reduces to $\lambda_c$=2a. Since waveguides are generally designed to have a static geometry, the operational frequency and bandwidth of conventional waveguides is limited.

Horn antennas are essentially open-ended waveguides in which the walls are gradually flared outwardly toward the radiating aperture. Horn antennas can be designed to support a particular mode, depending on the desired RF propagation antenna radiation pattern.

A type of horn antenna is a corrugated horn antenna. A corrugated horn antenna typically includes circumferential grooves, or corrugations, along the interior walls of the antenna. The depth of the corrugations are typically approximately one-quarter of a wavelength at the operating frequency, which substantially increases the surface impedance of the wall as compared to a smooth wall. The increased surface impedance results in the corrugated horn antenna having a symmetrical radiation pattern, that is, equal magnetic field and electric field radiation pattern plane cuts. The dominant mode in the corrugated conical horn is the $HE_{11}$ mode. In the $HE_{11}$ mode the corrugated horn has greater bandwidth as compared to a horn antenna having smooth walls and the corrugated horn exhibits lower attenuation than any mode of a horn antenna of comparable size. Nonetheless, the operational bandwidth of a typical corrugated horn antenna is still less than one octave.

To overcome the frequency and bandwidth limitations of horn antennas, International Patent Application No. PCT/GB92/01173 assigned to Loughborough University of Technology (Loughborough) proposes that a frequency selective surface (FSS) can be used within a waveguide to influence the frequency response. An FSS is typically provided in one of two arrangements. In a first arrangement, two or more layers of conductive elements are separated by a dielectric substrate. The elements are selected to resonate at a particular frequency at which the FSS will become reflective. The distance between the layers of conducive elements is selected to create a bandpass condition at a fundamental frequency at which the FSS becomes transparent and passes a signal. The FSS also can pass harmonics of the fundamental frequency. For example, if the fundamental frequency is 10 GHz, the FSS can pass 20 GHz, 30 GHz, 40 GHz, and so on.

Alternatively, FSS elements can be apertures in a conductive surface. The dimensions of the apertures can be selected so that the apertures resonate at a particular frequency. In this arrangement, the FSS elements pass signals propagating at the resonant frequency. Any other electromagnetic waves incident on the FSS surface are reflected from the surface.

In a multi-band waveguide or horn antenna, the FSS can form a second horn within a first horn wherein the second horn and first horn are tuned to different frequencies. This concept is not without its drawbacks, however. In particular, the horn proposed by Loughborough can generate grating lobes, which is electromagnetic energy that is scattered to uncontrolled directions. Grating lobes result from transmitted and scattered plane waves which do not obey Snell's laws of reflection and refraction. Causes of grating lobes are relatively large inter-element spacing within the FSS, large angles of incidence of plane wave with respect to surface, and/or both. Importantly, grating lobes adversely effect horn antenna performance and should be avoided.

Further, the walls of the horns proposed by Loughborough consist of conventional FSS's. Notably, Loughborough's horns do not include corrugations on the horn walls. Such corrugations would disrupt the transparency of the conventional FSS's. Specifically, conventional FSS elements are rather large on comparison to the distance between corrugation ridges. The separation between corrugation ridges may be less than a diameter of a conventional FSS element. Thus, the corrugation ridges would overlap the FSS elements and disrupt FSS element operation, thereby severely degrading the performance of the horns. Accordingly, there exists a need for a corrugated horn antenna incorporating a FSS, wherein the corrugations do not disrupt operation of the FSS elements.

SUMMARY OF THE INVENTION

The present invention relates to an antenna for microwave radiation including a first horn which includes a plurality of corrugations. At least one of the corrugations is formed of a frequency selective surface (FSS) having a plurality of FSS elements coupled to at least one substrate. The substrate can have a relative permittivity and/or relative permeability which is greater than 1. The substrate can define a first propagation medium such that an RF signal having a first wavelength in the first propagation medium can pass through the FSS. The FSS is coupled to a second propagation medium such that in the second propagation medium the RF signal has a second wavelength which is at least twice as long as a physical distance between centers of adjacent FSS elements. The second wavelength can be different than the first wavelength.

The FSS elements can include apertures in a conductive surface and/or conductive elements. The FSS also can include a plurality of dielectric layers and/or a plurality of FSS element layers. The antenna can further include at least one dielectric layer for matching an impedance of the first propagation medium to an impedance of the second propagation medium.

The antenna also can include at least a second horn positioned within the first horn. The second horn can include at least one corrugation having a FSS. A third horn including at least one corrugation having a FSS can be positioned within the second horn.

DETAILED DESCRIPTION OF THE PREFERRED EMBODIMENTS

Figure 1A:
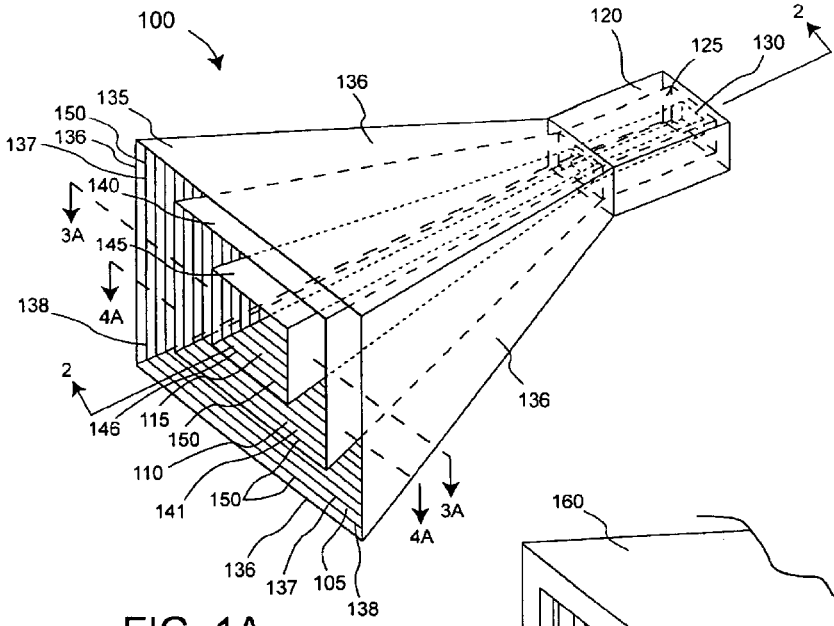
FIG. 1A is a perspective view of a multi-band horn antenna that is useful for understanding the present invention.
Figure 2:
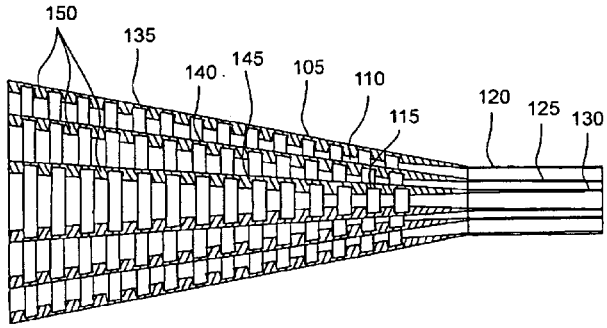
FIG. 2 is a cross sectional view of the multi-band horn antenna of FIG. 1.

The present invention concerns a multi-band horn antenna (multi-band horn) 100 which includes corrugations having frequency selective surfaces (FSS's), an example of which is shown in FIG. 1A. A cross sectional view of the multi-band horn antenna 100 taken along section lines 2—2 is shown in FIG. 2. Although the multi-band horn 100 shown has a pyramidal shape, the skilled artisan will appreciate that horns are available in a number of different shapes and the invention is not so limited. For example, the horn can be cylindrical, conical, parabolic, or any other suitable shape.

Figure 1B:
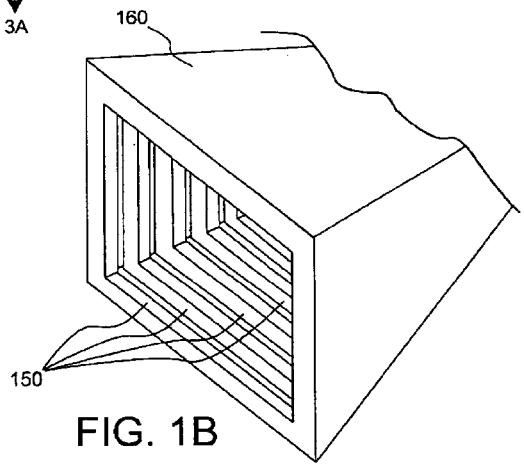
FIG. 1B is an enlarged view of a horn section having a corrugated surface that is useful for understanding the present invention.

Making reference to FIGS. 1A and 2, the multi-band horn 100 can include a first horn section 105 and a second horn section 110 which is concentrically disposed within the first horn section 105. At least one of the horn sections 105, 110 can be a corrugated horn which includes circumferential grooves, or corrugations 150, along the interior walls of the antenna. An enlarged view of an exemplary horn section 160 having corrugations 150 is shown in FIG. 1B.

The depth of the corrugations 150 are typically approximately one-quarter of a wavelength at the operating frequency, which substantially increases the surface impedance of the wall as compared to a smooth wall. Nonetheless, it sometimes can be advantageous to include corrugations having other depths. For example, in one arrangement the corrugations 150 can be gradually varied from one-half of a wavelength to one-quarter of a wavelength over a length of the interior walls.

Referring again to FIGS. 1A and 2, the first horn section 105 can be operatively connected to a first waveguide 120. A second waveguide 125, to which the second horn section 110 is operatively connected, can be concentrically disposed within the first waveguide 120. The waveguides 120, 125 can be smoothed walled, or corrugations can be provided along the interior walls of the waveguides 120, 125.

The waveguides 120, 125 can feed signals to the first horn section 105 and the second horn section 110, respectively. Hereinafter, the first horn section 105 and first waveguide 120 are collectively referred to as first horn 135. Also, the second horn section 110 and second waveguide 125 are collectively referred to as second horn 140.

The first horn 135 can comprise one or more walls 136 formed from corrugated surfaces 137 which are conductive. In an alternate arrangement, the walls 136 can be formed from a FSS. For example, the first horn 135 can comprise corrugations 150 having a FSS 138 designed to reflect signals only in the frequency band that the first horn 135 is designed to operate (as is further discussed below). Accordingly, the FSS's 138 can still provide signal reflection required for proper control of the wall 136 surface impedance, while the radar signature and broadband reflection of the multi-band horn 100 outside of the horn's operating band can be minimized. This can be a very useful feature if the multi-band horn 100 is operating proximate to other RF equipment which may be adversely affected by the presence of a broadband reflective surface. Further, a reduced radar signature can be beneficial if the multi-band horn 100 is to be used with a vehicle or craft intended to have a small radar signature.

Each of the horn sections 105, 110, 115 can operate over a different frequency range. For instance, the second horn 140 can comprise a corrugated FSS 141 having FSS elements (not shown). The FSS elements can be tuned to reflect signals in a frequency band which is different than the operating frequency band of the first horn 135, while being substantially transparent to signals in the operating frequency band of the first horn 135. Accordingly, the second horn 110 can increase the operational frequency range of the multi-band horn 100 without adversely affecting operational performance of the first horn 135.

Additional horns and waveguides can be incorporated into the multi-band horn 100. For example, a third horn section 115 can be disposed within the second horn section 110, a fourth horn (not shown) can be disposed within the third horn section 115, and so on. Likewise, a third waveguide 130 can be disposed within the second waveguide 125, etc. The third horn section 115 and third waveguide 130 can form a third horn 145.

Each successive horn can be designed using a FSS to operate at a different frequency than the other horns. Notably, the inner horns can be corrugated or non-corrugated, or a combination of both types of surfaces. For example, the second horn 140 can be a corrugated horn while the third horn 145 is non-corrugated. It will be appreciated by the skilled artisan that a number of horn combinations can be provided.

Generally, the operational frequency should increase as the horns become smaller. For proper horn operation, it is preferred that the third horn 145 be transparent to the operating frequency bands of both the first horn 135 and the second horn 140. For example, the FSS 146 of the third horn 145 can include FSS elements (not shown) which are reflective in the operational frequency band at which the third horn 145 operates, but pass frequency bands at which the first horn 135 and second horn 140 operate. Likewise, if a fourth horn (not shown) is provided, the fourth horn should be transparent to the operating frequency bands of the first horn 135, the second horn 140 and the third horn 145, etc.

Frequency Selective Surfaces

Figure 3A:
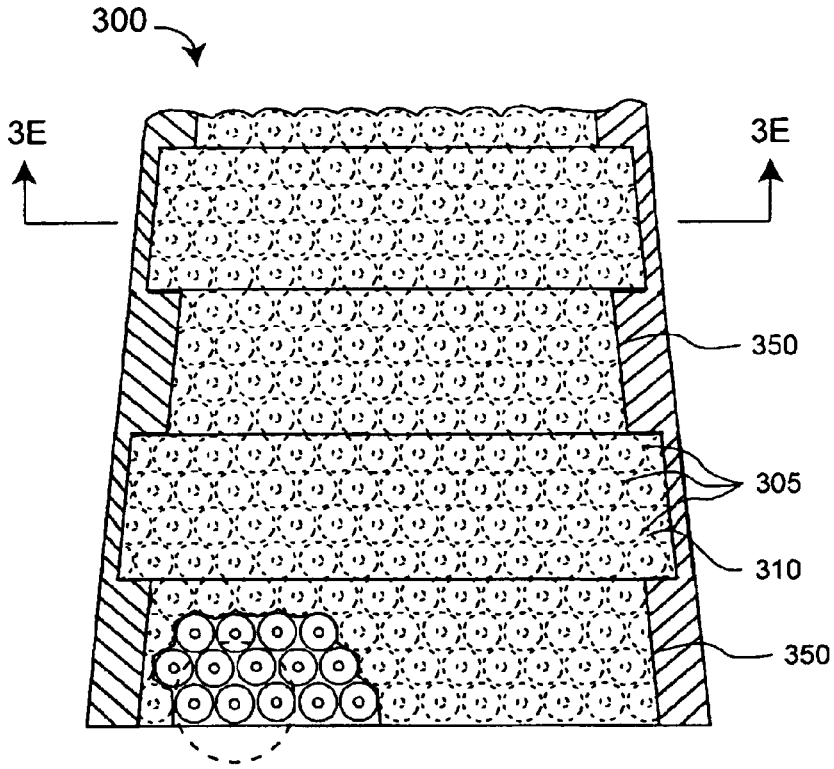
FIG. 3A is a partial cutaway cross-sectional view of the third horn of FIG. 1 taken along sections lines 3A—3A illustrating an exemplary frequency selective surface (FSS) which can be used as a corrugation surface.

Referring to FIG. 3A, there is shown an exemplary FSS 300 for use as a surface of third horn 145 within the multi-band horn 100, or as a wall within the waveguide 100. The FSS 300 can be formed to have corrugations 350. A perspective view of a corrugation having FSS elements 305 is shown in FIG. 3C. As shown, the corrugation 350 can have FSS elements 305 on an upper portion 352, side portions 354, 356 and lower portions 358, 360 of the corrugation 350.

Together, the upper portion 352 and side portions 354, 356 can form a corrugation ridge. In a preferred arrangement, FSS elements 305 do not overlap any sharp breaks in contour. For instance, it is preferred that an FSS element 305 does not extend past an intersection 362 of the side portions 354, 356 with the upper portion 352, or extend past an intersection 364 of the side portions 354, 356 with the lower portions 358, 360. An FSS element which overlaps an intersection 362, 364 may not be electromagnetically reflective or transparent at proper frequencies due to the effect of the sharp contour on the FSS element geometry. Nonetheless, in some instances, the effects of having a small percentage of FSS elements with an incorrect geometry can be tolerated. In such cases, the corrugations can be cost effectively formed by bending a FSS, and allowing some FSS elements to be located on a bend. For example, in some instances up to 15% of the FSS elements can be located at corrugation bends.

Figure 3B:
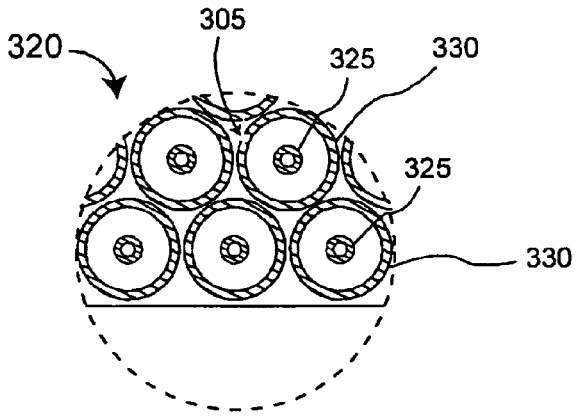
FIG. 3B is an enlarged view of the FSS elements of FIG. 3A.
Figure 3C:
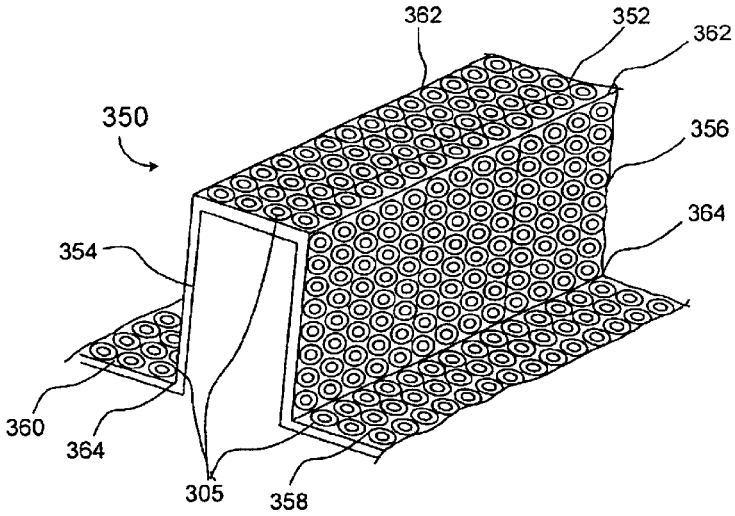
FIG. 3C is an enlarged perspective view of a corrugated surface having FSS elements, which is useful for understanding the present invention.
Figure 3D:
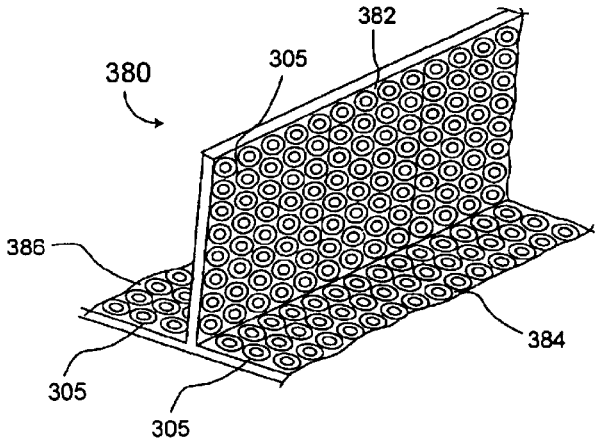
FIG. 3D is an enlarged perspective view of an alternate arrangement of a corrugated surface having FSS elements, which is useful for understanding the present invention.

A perspective view of an alternate corrugation 380 which can be used is shown in FIG. 3D. The corrugation 380 can include a narrow ridge 382 formed of a single FSS portion having FSS elements 305. The corrugation 380 also can include lower portions 384, 386 which incorporate FSS elements 305. Such a configuration can be used in thin ridge corrugation designs. Still other corrugations configurations can be used. For instance the corrugations can be ring-loaded slots, which are known to the skilled artisan, or any other type of corrugation. For instance, the corrugations can be trapezoidal, wedge shaped, include radiuses, or have any other desired geometry.

Referring again FIG. 3A, the FSS 300 can comprise a substrate 310 having a high permittivity and/or high permeability. For instance, the permittivity and/or permeability can be greater than 3. Since the propagation velocity of a signal traveling through a medium is equal to $$\frac{c}{\sqrt{\mu_r \varepsilon_r}},$$

where $\mu_r$ is the relative permeability of the medium and $\epsilon_r$ is the relative permittivity or dielectric constant of the medium, increasing the permeability and/or permittivity in the substrate 310 decreases propagation velocity of the signal in the substrate 310, and thus the signal wavelength.

A portion of the substrate 310 is shown cut away to reveal the FSS elements 305. The FSS elements 305 are shown for exemplary purposes, and it should be noted that the present invention is not limited to any particular element type. An FSS element typically resonates at a signal wavelength which is proportional to the size of the element, for example when the FSS element is one-half of the signal wavelength. Hence, as the signal wavelength is decreased, the size of the FSS element can be reduced. Accordingly, the size of FSS elements 305 can be reduced by increasing the permeability and/or permittivity, thereby enabling the FSS elements to be spaced closer together. The reduction in inter-element spacing can be proportional to the decrease in element size. Accordingly, providing a substrate 310 with an increased permittivity and/or permeability (e.g. relative permittivity and/or relative permeability greater than 1) enables the FSS elements 305 to be spaced closer together than would be possible on a conventional FSS. In particular, the permittivity and/or permeability of the substrate 310 can be increased to enable the FSS elements 305 to be spaced close enough to fit a plurality of FSS elements on each corrugation surface in the horn antenna.

For example, if the relative permittivity of the substrate 310 is 50 and the relative permeability is 1, the propagation velocity of a signal within the substrate will be approximately 14% of the propagation velocity in air. The size of the FSS elements 305 which are tuned for a particular frequency can be decreased accordingly. Thus, the inter-element spacing of the FSS elements 305 can be reduced to a distance which is 14% of the distance that the inter-element spacing would be using a substrate having a relative permittivity and a relative permeability equal to 1. Further, if the relative permittivity remains at 50 and the relative permeability increases to 50, the size of the FSS elements can be reduced to 2% of what their size would be on a substrate having both a relative permittivity and a relative permeability equal to 1. Hence, the inter-element spacing of the FSS elements 305 can be reduced accordingly, for instance to 2% of the distance that the inter-element spacing would be using a substrate having a relative permittivity and a relative permeability equal to 1.

Figure 6A:
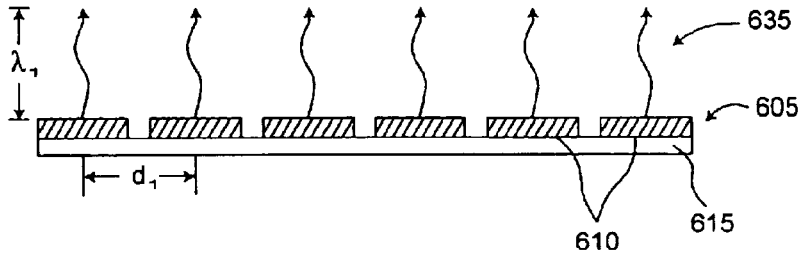
FIG. 6A (Prior Art)
FIG. 6A is an exemplary cross sectional view of a conventional FSS of the prior art.
Figure 6B:
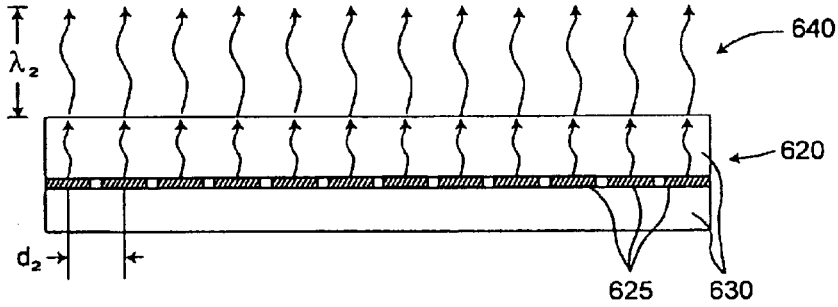
FIG. 6B is an exemplary cross sectional view of an FSS having increased permittivity and/or permeability relative to the conventional FSS of FIG. 6A.

In addition to enabling the FSS elements to be small enough for use in horn antenna corrugations, the reduction of inter-element spacing increases the operational bandwidth and performance of the FSS, as can be shown by making reference to FIGS. 6A and 6B. For exemplary purposes, FIG. 6A is a FSS 605 having FSS elements 610 and a low permittivity substrate 615, for instance having a relative permittivity of 3. FSS 620 having FSS elements 625 can have high permittivity substrates 630, for instance having a relative permittivity of 50. The operation of the FSS elements 610, 625 as reflectors can be modeled as point sources. Larger FSS elements 610 result in greater distance between point sources as compared to smaller FSS elements 625. Notably, as RF energy 640 transitions from FSS 620 to a second medium, such as free space air, the wavelength of the RF energy 640 increases. In particular, the ratio $(\lambda_2/d_2)$ of the wavelength $\lambda_2$ of RF energy 640 to the spacing $d_2$ between centers of FSS elements 625 is significantly greater than the ratio $(\lambda_1/d_1)$ of the wavelength $\lambda_1$ of RF energy 635 to the spacing $d_1$ between centers of FSS elements 610. For example, in a preferred arrangement the ratio $(\lambda_2/d_2)$ is at least two.

A greater ratio of wavelength to element spacing $(\lambda_2/d_2)$ reduces the scattering of electromagnetic energy in uncontrolled directions, thereby virtually eliminating the occurrence of grating lobes which can occur using typical FSS inter-element spacing. Grating lobes, which result from the array lattice geometry are moved to higher frequencies as the inter-element spacing is reduced; therefore, grating lobes, referred to as uncontrolled radiation, are effectively moved out of the frequency band of operation. An increased ratio $(\lambda_2/d_2)$ also improves FSS performance with respect to RF angles of incidence, which vary significantly from the performance at normal incidence. For example, the performance of the FSS can be optimized for improved broadband performance for RF signals having an angle of incidence between about 20 to 40 degrees relative to a plane which is perpendicular to the surface of the FSS. For instance, performance can be improved over a frequency band having a percentage bandwidth of greater than 45%. As defined herein, percentage bandwidth (% BW) is given by the equation $\% BW=(BW/f_c)\times 100$, where BW is the operational bandwidth of the FSS and $f_c$ is the operational center frequency of the FSS. Accordingly, the present invention enables a waveguide or horn antenna designer to optimize the size and separation of the FSS elements based on the angles of incidence that will be experienced in operation. The optimum size, spacing, and geometry of FSS elements for a particular FSS design can be determined empirically or with the use of a computer program which performs electromagnetic field and wave analysis using the Periodic Moment Method (PMM). The theory is based on a plane wave expansion technique which allows each infinite array of scatterers to be modeled by a single element called the reference element.

FIG. 3B shows an enlarged view 320 of the FSS elements 305 of FIG. 3A. As noted, the FSS elements 305 can be apertures in a conductive surface. For instance, the FSS elements can be apertures etched from a metalization layer of a substrate. The FSS elements also can be conductive elements. Notably, one or more layers of conductive elements can be provided. Further, the FSS can also include one or more layers of dielectric. Such FSS's are known to the skilled artisan. Moreover, although FSS elements 305 are shown as concentric circular rings, the invention is not so limited and any suitable FSS elements can be used.

Examples of the FSS elements which can be used are dipoles, tripoles, anchors, cross-dipoles, and Jerusalem crosses. Further, the FSS elements can be square rings, hexagons, loaded tripoles, four legged loaded dipoles, elliptical rings, elliptical hexagons, and concentric versions of such shapes. Moreover, the FSS elements can be combinations of element types, for example nested tripoles, nested anchor hexagons and 4-legged nested loaded dipoles. Such FSS element structures work well both in application using apertures or slot type elements and conductive or wire type elements. Conductive patch elements also can be used, for instance square patches, circular patches, and hexagonal patches. Still, there are a myriad of other FSS element types which can be used.

In the case that the FSS elements are apertures in a conductive surface, as shown in FIG. 3B, the FSS elements can be any suitable apertures which can pass and reflect signals propagating at desired frequency bands. In the case that FSS elements 305 are selected to pass two or more specific frequency bands, concentric apertures can be a suitable FSS element choice. For example an inner aperture 325 and an outer aperture 330, each of which are tuned to pass a different frequency band, can be used. Accordingly, the FSS 300 is suitable for use as surfaces of the third horn 145 or as walls of the waveguide 100. For instance, the inner aperture 325 can be selected to pass a frequency band from 20.2 GHz to 21.2 GHz, which can be the operational frequency band of the second horn 140, and the outer aperture 330 can be selected to pass a frequency band from 7.25 GHz to 8.4 GHz, which can be the operational frequency band of the first horn 135. Further, the FSS elements can be selected to reflect a frequency band from 30 GHz to 31 GHz, which can be the operational frequency band of the third horn 145.

The relative permittivity of the substrate 310 for FSS 300 should be considered when selecting the outer and inner diameters of the inner and outer element apertures 325, 330 to insure the apertures 325, 330 pass the proper frequency bands. For example, if the relative permittivity of the substrate 310 is 50, the inner diameter of inner aperture 325 could be 4 mils and the outer diameter of inner aperture 325 could be 9 mils to achieve a passband of 20.2 GHz to 21.2 GHz. Further, the inner diameter of outer aperture 330 could be 36 mils and the outer diameter of outer aperture 330 could be 41 mils to achieve a passband of 7.25 GHz to 8.4 GHz.

Figure 3E:
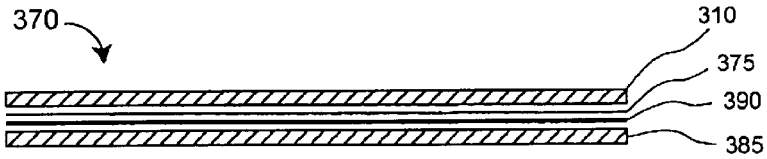
FIG. 3E is an exploded partial cross sectional view of the FSS of FIG. 3A taken along section lines 3E—3E.

FIG. 3E shows an exploded partial cross sectional view 370 of the FSS 300 of FIG. 3A taken along section line 3E—3E. As noted, the FSS 300 can include an array of FSS elements, which in the present example are concentric apertures in a conductive surface 375. The conductive surface 375 can be a metallization layer which has been applied to one or more layers of dielectric substrate 390. The dielectric substrate 390 can be, for example, polyester, polypropylene, polystyrene, polycarbonate, or any other suitable dielectric material.

Figure 4A:
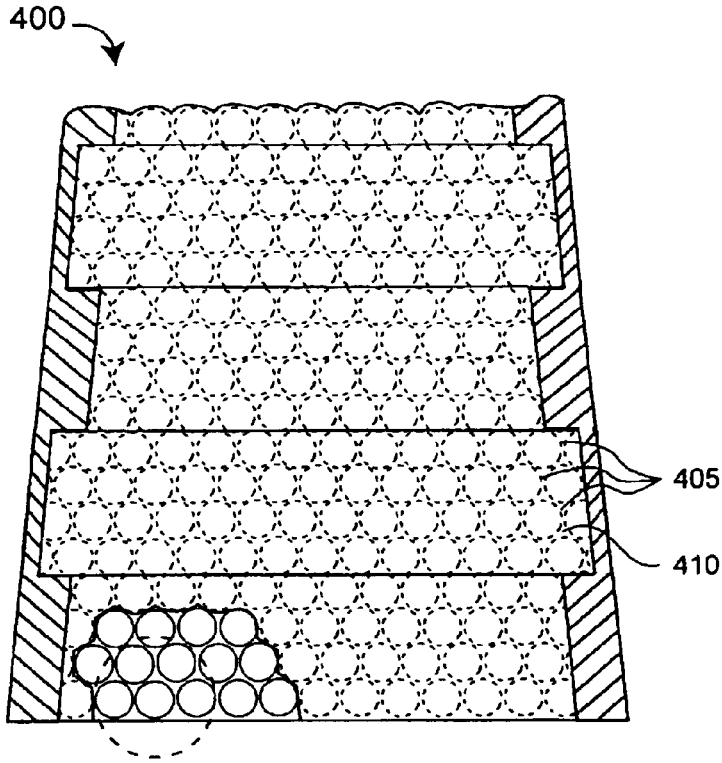
FIG. 4A is a partial cutaway cross-sectional view of the second horn of FIG. 1 taken along sections lines 4A—4A illustrating an exemplary FSS which can be used as a corrugation surface.
Figure 4B:
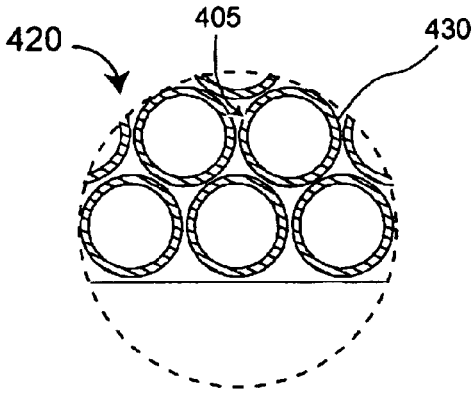
FIG. 4B is an enlarged view of the FSS elements of FIG. 4A.

Referring to FIG. 4A, an exemplary FSS 400 which can be used as a surface of the second horn is shown. A portion of the substrate 410 comprising the FSS 400 is shown cut away to reveal the FSS elements 405. FIG. 4B shows an enlarged view 420 of the FSS elements 405 of FIG. 4A. In contrast to the FSS elements 305 used for the third horn 145, the FSS elements 405 can comprise a single aperture 430 since the second horn need only pass a single frequency band, which in this example is the operational frequency band of the first horn 135.

Accordingly, for our example, the FSS elements 405 can be selected to pass a frequency band from 7.25 GHz to 8.4 GHz, while reflecting a frequency band from 20.2 GHz to 21.2 GHz. For instance, if the relative permittivity of the substrate 410 is 50, the inner diameter of inner aperture 405 could be approximately 4 mils and the outer diameter of inner aperture 405 could be approximately 9 mils.

At this point it should be noted that the FSS 400 having FSS elements 405 which are apertures is but one type of FSS that can be used with the present invention. Importantly, other types FSS's can be used. For instance, the FSS can include one or more layers of conductive FSS elements and one or more dielectric layers. Such FSS's are known to those skilled in the art.

As noted, it may be desirable for the substrate 410 to have a high permittivity and/or permeability. For instance, at least one of the permittivity and permeability can be greater than 3. In a preferred arrangement, the substrate 410 can be provided in the form of a high permittivity and/or high permeability material. In most cases it may preferable to utilize a low loss material to minimize power losses. For instance, the loss tangent can be less than 0.005. Nonetheless, there may be some applications where a certain amount of power loss is acceptable, or even desirable. In such cases, a material having a loss tangent equal to or higher than 0.005 can be provided. Further, the substrates 405 can be optimized to match the impedance of the FSS 400 to the impedance of free space, which is approximately 377 ohms, or any other medium in which the FSS 400 will be operated. High dielectric materials are discussed below.

Waveguide Assembly

Figure 5A:
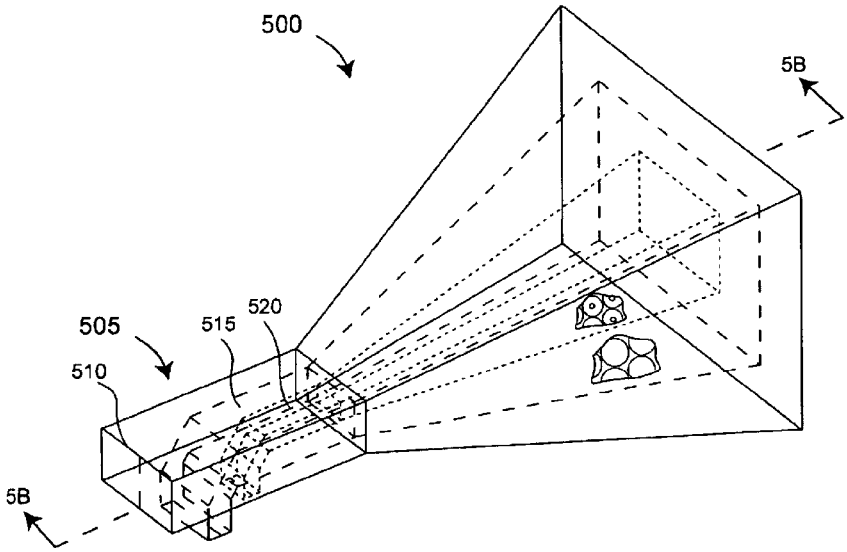
FIG. 5A is a perspective view of a multi-band horn antenna having an alternate waveguide arrangement that is useful for understanding the present invention.
Figure 5B:
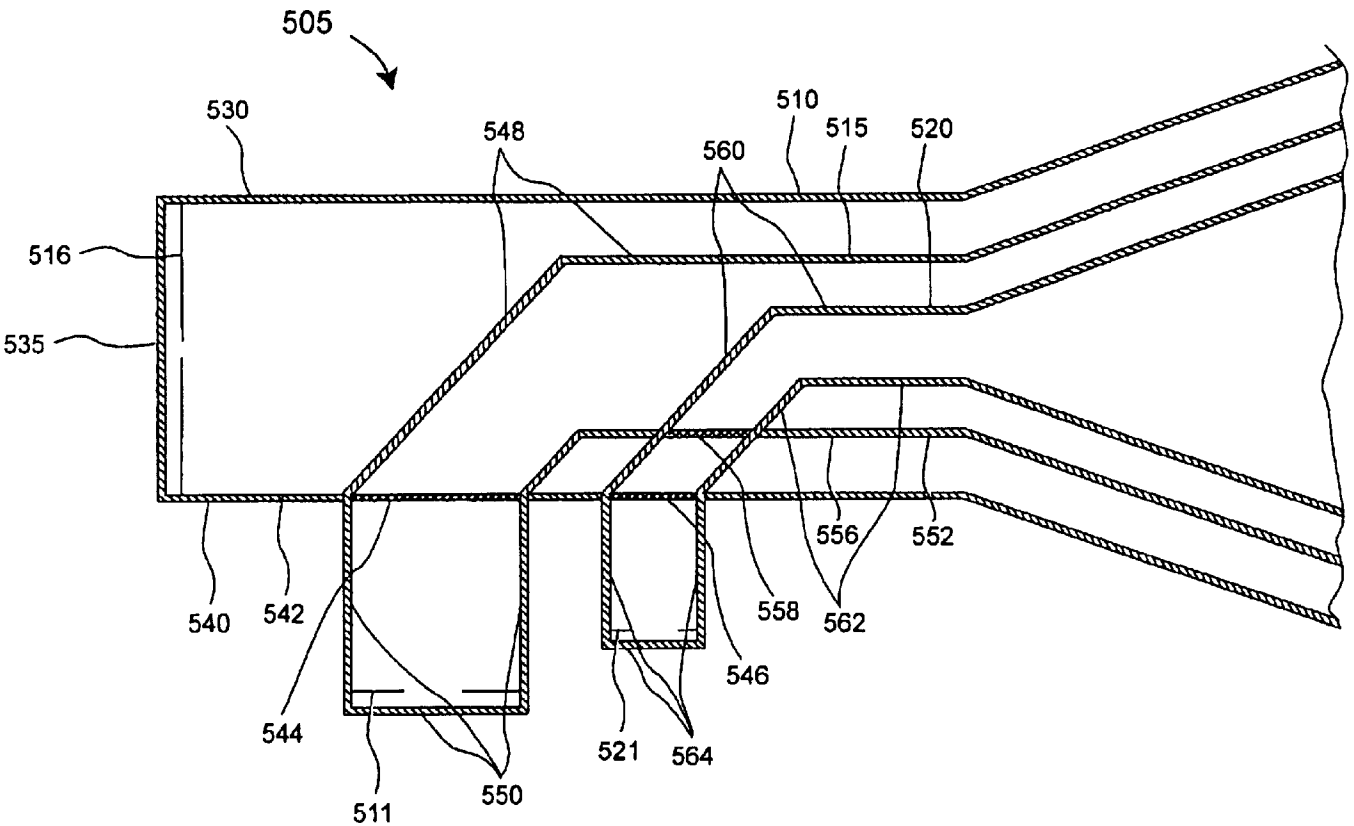
FIG. 5B is a cross-sectional view of a waveguide assembly of the multi-band horn antenna of FIG. 5A taken along section lines 5B—5B.

Referring to FIG. 5A, a multi-band horn antenna 500 having an alternate waveguide assembly 505 is presented. The waveguide assembly 505 can provide excellent horn feed characteristics for the multi-band horn antenna 500 by minimizing interactions of the waveguide assemblies with RF signals outside each waveguide's respective operational frequency range. A cross sectional view of the waveguide assembly 505 taken along section lines 5B—5B is shown in FIG. 5B. The waveguide assembly can include multiple concentric waveguides, for instance first waveguide 510, second waveguide 515 and third waveguide 520. Further, signal probes 511, 516, 521 can be disposed within each of the respective waveguides 510, 515, 520 for generating RF signals within the waveguides 510, 515, 520.

The first waveguide 510 can comprise a plurality of surface materials. For instance, the first waveguide 510 can include conductive surfaces, dielectric surfaces, FSS's, or a combination of such surfaces. Moreover, the surfaces can be corrugated, non-corrugated, or a combination of the two surface types. In one arrangement, waveguide walls (walls) 530, 535 can be conductive. Wall 540 can comprise conductive portions 542 and FSS portions 544, 546. FSS portion 544 can be disposed at an intersection of waveguide 510 and waveguide 515. FSS portion 544 can be configured to reflect RF signals in the operational frequency range of waveguide 510 and pass RF signals in the operational frequency range of waveguide 515. Likewise, FSS portion 546 can be disposed at an intersection of waveguide 510 and waveguide 520. Further, FSS portion 546 can be configured to reflect RF signals in the operational frequency range of waveguide 510 and pass RF signals in the operational frequency range of waveguide 520.

Waveguide 515 can include walls 548, 550, 552. Again, walls 548, 550, 552 can be corrugated or non-corrugated. Walls 550 can be conductive. Wall 552 can include a portion 558 which intersects waveguide 520, and a remaining non-intersecting portion 556. Walls 548, 550 and portion 556 of wall 552 can be FSS's which pass RF signals in the operational frequency range of waveguide 510, but are reflective to RF signals in the operational frequency range of waveguide 515. FSS portion 558 of wall 552 also can pass RF signals in the operational frequency range of the waveguide 510 and can be reflective to RF signals in the operational frequency range of waveguide 515. Further, FSS portion 558 also can pass RF signals in the operational frequency range of the waveguide 520.

Lastly, waveguide 520 can include waveguide walls 560, 562, 564, which can be corrugated or non-corrugated. Walls 564 can be conductive, while walls 560, 562 can be FSS's which are reflective to RF signals in the operational frequency range of the waveguide 520 and pass RF signals in the operational frequency ranges of the waveguides 510, 515. Accordingly, the respective waveguides can operate with little or no interference resulting from the multi-band configuration.

High Dielectric Materials

One example of a material which can be used to increase the relative permittivity of the substrates is titanium oxide ($TiO_2$). $TiO_2$ has a relative permittivity (dielectric constant) near 86 and a loss tangent of 0.0002 when measured perpendicular to the c-axis of the material, and a dielectric constant near 170 and loss tangent of 0.0016 when measured parallel to the c-axis. Another material which can be used is barium oxide (BaO) crystal, which has a dielectric constant of 34 and a loss tangent of 0.001. Still, many other materials are commercially available which can be used, for example SB350, SL390 and SV430 dielectric ceramics, each available from Kyocera Industrial Ceramics Corp. of Vancouver, Wash.; E1000, E3000 and E4000 ceramics available from Temex Corp. of Sevres Cedex, France; C-Stock AK available from Cuming Corp. of Avon, Mass.; and RT/6010LM available from Rogers Corp. of Rogers, Conn.

Meta-materials also can be used to provide substrates having medium to high relative permittivity and/or relative permeability. As defined herein, the term "meta-materials" refers to composite materials formed from the mixing or arrangement of two or more different materials at a very fine level, such as the angstrom or nanometer level. Meta-materials allow tailoring of electromagnetic properties of the composite. The materials to be mixed can include a plurality of metallic and/or ceramic particles. Metal particles preferably include iron, tungsten, cobalt, vanadium, manganese, certain rare-earth metals, nickel or niobium particles.

The particles are preferably nanometer size particles, generally having sub-micron physical dimensions, hereafter referred to as nanoparticles. The particles can preferably be organofunctionalized composite particles. For example, organofunctionalized composite particles can include particles having metallic cores with electrically insulating coatings or electrically insulating cores with a metallic coating.

Magnetic metamaterial particles that are generally suitable for controlling magnetic properties of dielectric layer for a variety of applications described herein include ferrite organoceramics (FexCyHz)—(Ca/Sr/Ba-Ceramic). These particles work well for applications in the frequency range of 8–40 GHz. Alternatively, or in addition thereto, niobium organoceramics (NbCyHz)—(Ca/Sr/Ba-Ceramic) are useful for the frequency range of 12–40 GHz. The materials designated for high frequency applications may also be applicable to low frequency applications. These and other types of composite particles can be obtained commercially.

In general, coated particles are preferable for use with the present invention as they can aid in binding with a polymer matrix or side chain moiety. Particles can be applied to a substrate by a variety of techniques including polyblending, mixing and filling with agitation. For example, a dielectric constant may be raised from a value of 2 to as high as 10 by using a variety of particles with a fill ratio of up to about 70%. Metal oxides useful for this purpose can include aluminum oxide, calcium oxide, magnesium oxide, nickel oxide, zirconium oxide and niobium (II, IV and V) oxide. Lithium niobate (LiNbO3), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective relative dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a relative dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a relative dielectric constant generally in the range of 70 to 400± 10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a relative dielectric constant of about 1100 to 2650. Doping percentages for these materials are generally from about 1% to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, UV, x-ray, e-beam or ion-beam irradiation. Lithography can also be performed using photo, UV, x-ray, e-beam or ion-beam radiation.

Liquid crystal polymers (LCP's) also can be used in the upper and/or lower substrate 380, 385. LCP's, which are characterized as having liquid crystal states and have a number of unique characteristics that result in physical properties that can be significantly responsive to a variety of energetic stimuli. The liquid crystal state is a distinct phase of matter, referred to as a mesophase, observed between the crystalline (solid) and isotropic (liquid) states. Liquid crystals are generally characterized as having long-range molecular-orientational order and high molecular mobility. There are many types of liquid crystal states, depending upon the amount of order in the material.

Liquid crystals are anisotropic materials, and the physical properties of the system vary with the average alignment with the preferred orientation direction of the molecules, referred to as the director. If the alignment is large, the material is very anisotropic. Similarly, if the alignment is small, the material is almost isotropic.

The nematic liquid crystal phase is characterized by molecules that have no positional order but tend to point in the same direction (along the director). As the temperature of this material is raised, a transition to a black, substantially isotropic liquid can result.

The smectic state is another distinct mesophase of liquid crystal substances. Molecules in this phase show a higher degree of translation order compared to the nematic state. In the smectic state, the molecules maintain the general orientational order of nematics, but also tend to align themselves in layers or planes. Motion can be restricted within these planes, and separate planes are observed to flow past each other. The increased order means that the smectic state is more solid-like than the nematic. Many compounds are observed to form more than one type of smectic phase.

Another common liquid crystal state can include the cholesteric (chiral nematic) liquid crystal phase. The chiral nematic state is typically composed of nematic mesogenic molecules containing a chiral center that produce intermolecular forces that favor alignment between molecules at a slight angle to one another. Columnar liquid crystals are different from the previous types because they are shaped like disks instead of long rods. A columnar mesophase is characterized by stacked columns of molecules.

Many liquid crystal polymers provide substantially alignable regions therein. For example, some LCP's are responsive to electric and magnetic fields, and produce differing responses based on the orientation of the applied fields relative to the director axis of the LCP.

Applying an electric field to a liquid crystal molecule with a permanent electric dipole can cause the dipole to align with the field. If the LCP molecule did not originally have a dipole, a dipole can be induced when the field is applied. This can cause the director of the LCP to align with the direction of the electric field being applied. As a result, physical properties, such as the dielectric constant of the LCP can be controlled using an electrical field. Only a very weak electric field is generally needed to accomplish this in the LCP. In contrast, applying an electric field to a conventional solid has little effect because the molecules are held in place by their bonds to other molecules, unless the solid is ferroelectric or ferromagnetic. Similarly, in liquids, the high kinetic energy of the molecules can make orienting a liquid's molecules by applying an electric field difficult with prior art technology.

Since the electric dipole across LCP molecules varies in degree along the length and the width of the molecules, some LCP's require less electric field and some require much more in order to align the director. The ratio of electric dipole per unit volume of crystal to the field strength referred to as the electric susceptibility and provides a measure of how easy it is to electrically polarize the material. LCP responses to an electrical field can be referred to as a liotropic (sometimes written as lyotropic) response.

Magnetic dipoles also can be inherent, or more likely, can be induced in the LCP by applying a magnetic field. Thus, there can be a corresponding magnetic susceptibility associated with the LCP's. As with an applied electrical field, application of a magnetic field across an LCP can be used to change or control physical properties of the LCP, such as the dielectric constant. In addition to changing physical properties in response to electrical and magnetic fields, temperature and photonic radiation can also be used for modification of dielectric properties of the LCP. LCP responses to heat can be referred to as thermotropic responses.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. An antenna for microwave radiation comprising a first horn, said first horn comprising a plurality of corrugations, at least one of said corrugations formed of a frequency selective surface (FSS) having a plurality of FSS elements coupled to at least one substrate.

2. The antenna according to claim 1, wherein said substrate has at least one of a relative permittivity and a relative permeability which is greater than 1.

3. The antenna according to claim 1, wherein said substrate defines a first propagation medium such that an RF signal having a first wavelength in said first propagation medium can pass through said FSS, wherein said FSS is coupled to a second propagation medium such that in said second propagation medium said RF signal has a second wavelength which is at least twice as long as a physical distance between centers of adjacent ones of said FSS elements.

4. The antenna of claim 3, wherein said second wavelength is different than said first wavelength.

5. The antenna of claim 3, wherein said FSS comprises at least one dielectric layer for matching an impedance of said first propagation medium to an impedance of said second propagation medium.

6. The antenna of claim 1, further comprising at least a second horn positioned within said first horn, said second horn comprising at least one FSS.

7. The antenna of claim 6, further comprising at least a third horn positioned within said second horn, said third horn comprising at least one FSS.

8. The antenna of claim 1, wherein said FSS comprises a plurality of dielectric layers.

9. The antenna of claim 1, wherein said FSS comprises a plurality of FSS element layers.

10. The antenna of claim 1, wherein said FSS elements comprise apertures in a conductive surface.

11. The antenna of claim 1, wherein said FSS elements comprise conductive elements.

12. An antenna for microwave radiation comprising:

a first horn; and at least a second horn positioned within said first horn, said second horn comprising a plurality of corrugations, at least one of said corrugations formed of a frequency selective surface (FSS) having a plurality of FSS elements coupled to at least one substrate.

13. The antenna according to claim 12, wherein said substrate has at least one of a relative permittivity and a relative permeability which is greater than 1.

14. The antenna according to claim 12, wherein said substrate defines a first propagation medium such that an RF signal having a first wavelength in said first propagation medium can pass through said FSS, wherein said FSS is coupled to a second propagation medium such that in said second propagation medium said RF signal has a second wavelength which is at least twice as long as a physical distance between centers of adjacent ones of said FSS elements.

15. The antenna of claim 14, wherein said FSS comprises at least one dielectric layer for matching an impedance of said first propagation medium to an impedance of said second propagation medium.

16. The antenna of claim 14, wherein said second wavelength is different than said first wavelength.

17. The antenna of claim 12, further comprising at least a third horn positioned within said second horn, said third horn comprising at least one FSS.

18. The antenna of claim 12, wherein said FSS comprises a plurality of dielectric layers.

19. The antenna of claim 12, wherein said FSS comprises a plurality of FSS element layers.

20. The antenna of claim 12, wherein said FSS elements comprise apertures in a conductive surface.

21. The antenna of claim 12, wherein said FSS elements comprise conductive elements.

* * * * *